US009719709B2

(12) United States Patent
Abe et al.

(10) Patent No.: US 9,719,709 B2
(45) Date of Patent: Aug. 1, 2017

(54) AIR-CONDITIONING APPARATUS WITH THERMO-OFF POSTPONEMENT CONTROL

(71) Applicant: Mitsubishi Electric Corporation, Tokyo (JP)

(72) Inventors: Ryoji Abe, Tokyo (JP); Masanori Aoki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 257 days.

(21) Appl. No.: 14/520,540

(22) Filed: Oct. 22, 2014

(65) Prior Publication Data

US 2015/0135753 A1 May 21, 2015

(30) Foreign Application Priority Data

Nov. 21, 2013 (JP) ..... 2013-241049

(51) Int. Cl.
*F25B 49/02* (2006.01)
*F25B 1/00* (2006.01)
(Continued)

(52) U.S. Cl.
CPC ..... *F25B 49/022* (2013.01); *F25B 1/005* (2013.01); *F25B 49/005* (2013.01); *F25B 49/025* (2013.01); *F25B 13/00* (2013.01); *F25B 2313/0314* (2013.01); *F25B 2500/08* (2013.01); *F25B 2600/02* (2013.01); *F25B 2600/025* (2013.01); *F25B 2600/0251* (2013.01); *F25B 2700/21162* (2013.01); *F25B 2700/21172* (2013.01)

(58) Field of Classification Search
CPC ..... F25B 49/022; F25B 2600/02; F25B 2600/025; F25B 2600/0251; F25B 2600/0252; F25B 2600/0253; F25B 2700/21172
See application file for complete search history.

(56) References Cited

U.S. PATENT DOCUMENTS 6,519,957 B2 * 2/2003 Huh ..... F25B 49/022 62/175
2002/0134094 A1 9/2002 Huh et al.

FOREIGN PATENT DOCUMENTS

CN 1138948 C 2/2004
JP S63-282443 A 11/1988
(Continued)

OTHER PUBLICATIONS

JP 2011-202885 (English Translation).*
(Continued)

*Primary Examiner* — Jonathan Bradford
(74) *Attorney, Agent, or Firm* — Posz Law Group, PLC

(57) ABSTRACT

It is determined whether thermo-off postponement control is allowed or not on the basis of a current compressor operating frequency when a thermo-off condition is satisfied. If it is determined that thermo-off postponement control is allowed, the thermo-off postponement control in which a lowest operating frequency in an operating frequency range of a compressor is temporarily reduced within a range greater than or equal to a minimum operating frequency of the compressor in use so as to continue an operation. If it is determined that thermo-off postponement control is not allowed, thermo-off of stopping the compressor is performed.

8 Claims, 3 Drawing Sheets

(51) Int. Cl.
*F25B 49/00* (2006.01)
*F25B 13/00* (2006.01)

(56) References Cited

FOREIGN PATENT DOCUMENTS

| | | | |
|---|---|---|---|
| JP | H08-219530 | A | 8/1996 |
| JP | H10-148377 | A | 6/1998 |
| JP | 2009-030878 | A | 2/2009 |
| JP | 2011-202885 | A | 10/2011 |

OTHER PUBLICATIONS

Office Action issued Jan. 5, 2016 in the corresponding JP application No. 2013-241049 (with English translation).
Extended European Search Report mailed Mar. 26, 2015 in the corresponding European Patent application No. 14193339.0.
Office Action dated Jan. 26, 2017 issued in corresponding CN patent application No. 201410668262.5 (and English translation).

* cited by examiner

AIR-CONDITIONING APPARATUS WITH THERMO-OFF POSTPONEMENT CONTROL

TECHNICAL FIELD

The present invention relates to an air-conditioning apparatus.

BACKGROUND ART

A typical air-conditioning apparatus sets an operating frequency of a compressor at a high value at start-up in which the difference between an indoor inlet temperature and a set temperature is large, and sets the operating frequency of the compressor at a low value when the difference between the indoor inlet temperature and the set temperature is low (see, for example, Patent Literature 1).

CITATION LIST

Patent Literature

[Patent Literature 1] Japanese Unexamined Patent Application Publication No. 63-282443 (FIGS. 2 and 3)

SUMMARY OF INVENTION

Technical Problem

However, when the compressor operating frequency is reduced, the discharge temperature of the compressor does not increase, and a refrigerant in a liquid phase is sucked in, that is like, a so-called liquid back phenomenon occurs in operation, and the compressor might be broken at worst. In the case of using non-compatible oil in a heating operation at a low outdoor-air temperature, for example, the reduction in the compressor operating frequency increases the viscosity of refrigerating machine oil in an evaporator so that the refrigerating machine oil easily accumulates, resulting in the possibility of deterioration of oil return. That is, in some operating conditions (e.g., outdoor-air temperature and operating conditions (including properties of lubricating oil in use)), a decrease in the compressor operating frequency might cause a decrease in the reliability of an air-conditioning apparatus disadvantageously.

The decrease in the compressor operating frequency leads to a discomfort due to humidity caused by a decrease in dehumidification amount even with a reduced room temperature in a cooling operation. The decrease in the compressor operating frequency also leads to a draught feeling due to a reduced outlet temperature in a heating operation.

To avoid these situations, measures have been taken by performing correction (hereinafter referred to as up correction) that increases the lowest operating frequency in an operating frequency range of a compressor in accordance with operating conditions. In the measures, however, the operating frequency of the compressor cannot be reduced below the lowest operating frequency after the correction. Thus, in a case where the air conditioning capacity needs to be reduced in accordance with a decrease in air conditioning load, the air conditioning capacity cannot be reduced sufficiently. Thus, to reduce the air conditioning capacity, the operating frequency of the compressor is not reduced, and instead, thermo-off (compressor stop) and thermo-on (compressor operation) are repeated, that is, an intermittent operation is performed. Such an intermittent operation disadvantageously reduces the efficiency of equipment, and causes the indoor inlet temperature to vary significantly, which deteriorates the degree of comfort.

It is therefore an object of the present invention to provide an air-conditioning apparatus that can minimize an intermittent operation of a compressor so as to reduce a decrease in efficiency of the air-conditioning apparatus caused by the intermittent operation and to reduce variation of an indoor inlet temperature caused by the intermittent operation.

Solution to Problem

An air-conditioning apparatus according to the present invention includes: an outdoor unit including a compressor; an indoor unit; inlet temperature detection means that detects an indoor inlet temperature; and a controller that performs control of reducing an operating frequency of the compressor as a difference between the indoor inlet temperature and a set temperature decreases, wherein the controller determines whether thermo-off postponement control is allowed or not on the basis of a current operating frequency of the compressor in a case where the indoor inlet temperature is less than or equal to a thermo-off set temperature in a cooling mode or the indoor inlet temperature is greater than or equal to the thermo-off set temperature in a heating mode so that a thermo-off condition is satisfied, if the controller determines that the thermo-off postponement control is allowed, the controller performs thermo-off postponement control in which a lowest operating frequency in an operating frequency range of the compressor is temporarily reduced within a range greater than or equal to a minimum operating frequency of the controller and operation is continued, and if the controller determines that the thermo-off postponement control is not allowed, the controller performs thermo-off in which the compressor is stopped.

Advantageous Effects of Invention

According to the present invention, an intermittent operation of a compressor can be minimized. Thus, a decrease in efficiency of an air-conditioning apparatus caused by the intermittent operation and a variation of an indoor inlet temperature caused by the intermittent operation can be reduced.

DESCRIPTION OF EMBODIMENTS

Embodiment 1

Figure 1:
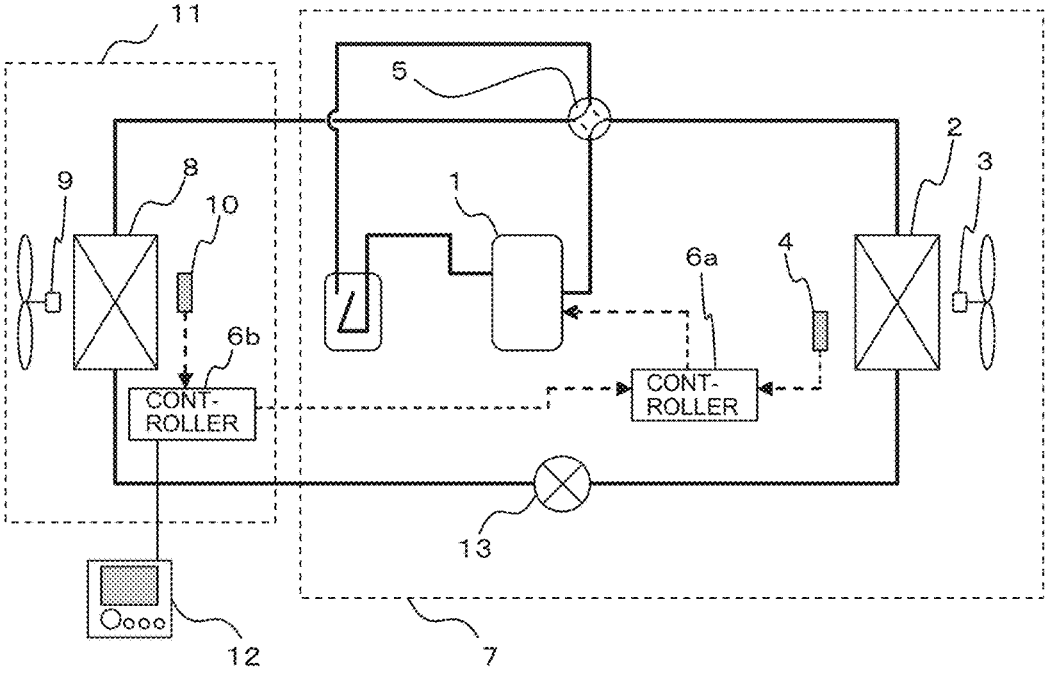
FIG. 1 schematically illustrates a refrigerant circuit of an air-conditioning apparatus according to Embodiment 1 of the present invention.

FIG. 1 schematically illustrates a refrigerant circuit of an air-conditioning apparatus according to Embodiment 1 of the present invention.

The air-conditioning apparatus includes an outdoor unit 7 and an indoor unit 11. The outdoor unit 7 includes, for example, a compressor 1, a heat exchanger 2, a fan 3, outdoor-air temperature detection means 4 constituted by, for example, a thermistor, a four-way valve 5, a controller 6*a*, and an expansion part 13. The indoor unit 11 includes, for example, a heat exchanger 8, a fan 9, inlet temperature detection means 10 constituted by, for example, a thermistor, and a controller 6*b*.

The compressor 1, the four-way valve 5, the heat exchanger 2, the expansion part 13, and the heat exchanger 8 are sequentially connected by pipes, thereby constituting a refrigerant circuit.

The air-conditioning apparatus further includes a remote controller 12 serving as an interface that allows a user to determine a set temperature.

In FIG. 1, the expansion part 13 is provided in the outdoor unit 7. Alternatively, the expansion part 13 may be provided in the indoor unit 11 or may be provided in each of the outdoor unit 7 and the indoor unit 11.

FIG. 1 illustrates an example combination in which one indoor unit 11 and one outdoor unit 7 are provided as a pair. The air-conditioning apparatus of the present invention is not limited to this example. Specifically, a plurality of indoor units 11 may be connected to one outdoor unit such that the indoor units 11 operate at the same time, or alternatively, each of the indoor units 11 operates individually.

In addition, in Embodiment 1, examples of refrigerant that circulates in the refrigerant circuit include HCFC refrigerant such as R22, HFC refrigerant such as R407C, R410A, and R32, and natural refrigerant such as $CO_2$ and ammonia.

The controller 6*b* in the indoor unit 11 is constituted by, for example, a microcomputer, obtains information on an inlet temperature detected by the inlet temperature detection means 10 and operation instruction information instructed from a user through a remote controller 12, and transmits the information to the controller 6*a* in the outdoor unit 7.

The controller 6*a* in the outdoor unit 7 is constituted by, for example, a microcomputer and controls the components based on information on an outdoor-air temperature detected by the outdoor-air temperature detection means 4 and information transmitted from the controller 6*a* in the indoor unit 11. The controller 6*a* performs normal operation (in a cooling mode and a heating mode) by switching the four-way valve 5. The controller 6*a* performs up correction control that increases a lowest operating frequency of the compressor 1 in accordance with operating conditions in order to obtain at least one of reliability or comfort of the air-conditioning apparatus. In the present invention, an algorithm itself of the up correction control is not specifically limited, and any algorithm may be employed as long as the up correction control is performed in order to obtain reliability of the air-conditioning apparatus and/or comfort.

The controller 6*a* in the outdoor unit 7 and the controller 6*b* in the indoor unit 11 control the entire air-conditioning apparatus in combination. In the configuration of Embodiment 1, the controllers are provided in both of the outdoor unit 7 and the indoor unit 11. Alternatively, a controller having the functions of the controller 6*a* and the controller 6*b* may be provided in the outdoor unit 7 or the indoor unit 11. In the following description, the controllers 6*a* and 6*b* will be collectively referred to as a controller 6 when referring to the entire control of the controllers 6*a* and 6*b*.

Control of the controller 6 will now be described. First, a control method at the time of thermo-off will be described.

The controller 6 of the air-conditioning apparatus of Embodiment 1 monitors a difference between an indoor inlet temperature $T_{in}$ and a set temperature $T_{set}$ of the indoor unit 11 in a normal operation. As control of the controller 6, the controller 6 increases the compressor operating frequency as the difference increases, and reduces the compressor operating frequency as the difference decreases.

In the cooling mode, when the indoor inlet temperature $T_{in}$ detected by the inlet temperature detection means 10 reaches a temperature less than or equal to a thermo-off set temperature, the controller 6 determines that the indoor inlet temperature reaches a target temperature and a thermo-off condition is satisfied, and determines that thermo-off is allowed. In a heating mode, when the indoor inlet temperature $T_{in}$ detected by the inlet temperature detection means 10 increases to a temperature greater than or equal to the thermo-off set temperature, the controller 6 determines that the indoor inlet temperature $T_{in}$ reaches the target temperature and the thermo-off condition is satisfied, and determines that thermo-off is allowed.

A feature of the present invention resides in control performed when the controller 6 has determined that thermo-off is allowed as described below. Specifically, when the controller 6 has determined that thermo-off is allowed, unlike in a typical apparatus, thermo-off (i.e., compressor stop) is not necessarily performed immediately, and thermo-off postponement control in which the operating frequency of the compressor 1 is temporarily reduced so that the operation is carried on.

In the case where it has been determined that thermo-off is allowed, switching between the control of immediately performing thermo-off and the thermo-off postponement control depends on the current operating state. Specifically, in a case where a current (at the time of determining that thermo-off is allowed) compressor operating frequency $F_j$ is higher than a minimum operating frequency $F_{min}$ in application of the compressor 1 in use or equal to a lowest operating frequency Fi subjected to up correction in order to obtain reliability or comfort of the air-conditioning apparatus, the thermo-off postponement control is performed. Otherwise, thermo-off is performed immediately.

Here, a condition for performing the thermo-off postponement control is a condition in which the compressor operating frequency $F_j$ at the time when it is determined that thermo-off is allowed is higher than the minimum operating frequency $F_{min}$ in application of the compressor 1 in use. Alternatively, in order to reduce an abrupt change in the operating frequency of the compressor 1, a condition for performing the thermo-off postponement control may be condition (a) or (b) as follows:

(a) a condition in which the current compressor operating frequency $F_j$ is higher than the minimum operating frequency $F_{min}$ and is less than or equal to a predetermined threshold frequency $F_\gamma$; and (b) a condition in which condition (a) continues for a predetermined time.

The compressor operating frequency in the thermo-off postponement control is, for example, the minimum operating frequency $F_{min}$ in application of the compressor 1 in use. That is, in the thermo-off postponement control, the compressor operating frequency is reduced to the minimum operating frequency $F_{min}$ and operation of the compressor 1 is continued. The compressor operating frequency of the thermo-off postponement control only needs to be lower than the current operating frequency of the compressor, and does not need to be equal to the minimum operating frequency $F_{min}$.

On the other hand, in a case where the compressor operating frequency $F_j$ at the time when it is determined that thermo-off is allowed is equal to the minimum operating frequency $F_{min}$, thermo-off is performed immediately, which is the same as in a typical apparatus. That is, a situation in which the current operating frequency of the compressor is equal to the minimum operating frequency $F_{min}$ means that the current operation capacity is large for an air conditioning load even with the compressor operating frequency reduced to the minimum. Thus, in a case where the compressor operating frequency $F_j$ at the time it is determined that thermo-off is allowed is equal to the minimum operating frequency $F_{min}$, thermo-off is performed immediately. In the case of performing thermo-off in the manner described above, in order to reduce a load on the compressor 1 in restarting the compressor 1, a minimum compressor stoppage period $\tau_{off}$ for equalizing the high and low pressures, which will be described later, may be provided.

The air-conditioning apparatus controls the compressor operating frequency in accordance with the difference between the indoor inlet temperature $T_{in}$ and the set temperature $T_{set}$ in order to maintain comfort, and performs up correction in order to maintain reliability and comfort as described above. Thus, the compressor operating frequency in operation is adjusted to a frequency necessary to maintain reliability and comfort.

The thermo-off postponement control is performed at a compressor operating frequency that is lower than a compressor operation frequency originally required as described above. Thus, when the thermo-off postponement control continues longer than needed, it will be difficult to maintain the reliability and comfort of the air-conditioning apparatus. To prevent this, in Embodiment 1, a limitation (a thermo-off postponement duration time τk, which will be described later) is imposed on a period in which the thermo-off postponement control is performed. That is, for the thermo-off postponement control, only a short period that does not impair the reliability and comfort of the air-conditioning apparatus is permitted.

The foregoing description clarifies the concept of control of Embodiment 1. A specific flow of the control will now be described with reference to a flowchart.

Figure 2:
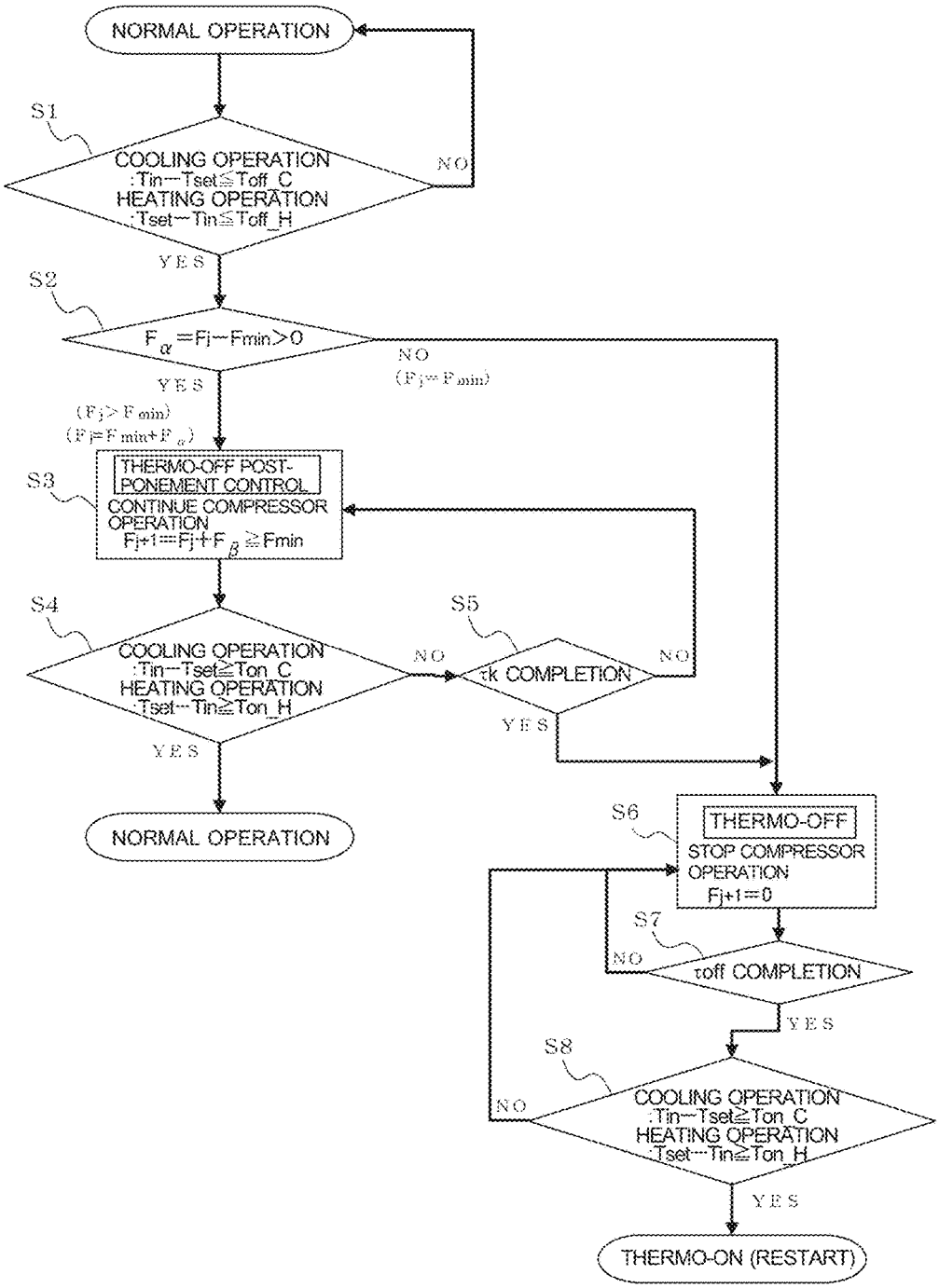
FIG. 2 is a flowchart showing a flow of control in the air-conditioning apparatus of Embodiment 1.

FIG. 2 is a flowchart showing a flow of control in the air-conditioning apparatus of Embodiment 1. A flow in the cooling mode will now be described.

First, when the remote controller 12 of the indoor unit 11 is turned on by a user, driving of the compressor 1 starts. By driving the compressor 1, a normal operation (a cooling operation in this example) performed by the air-conditioning apparatus starts. In this example, a temperature obtained by adding a cooling thermo-off threshold value $T_{off_C}$ (a negative value) to the set temperature $T_{set}$ is set as a thermo-off set temperature, and a temperature obtained by adding a cooling thermo-on threshold value $T_{on_C}$ to the set temperature $T_{set}$ is set as a thermo-on set temperature.

As described above, the controller 6 monitors the difference between the indoor inlet temperature $T_{in}$ of the indoor unit 11 and the set temperature $T_{set}$ in the normal operation. In the cooling mode, as control of the controller 6, the controller 6 increases the operating frequency of the compressor 1 as the difference increases, and reduces the operating frequency of the compressor 1 as the difference decreases.

The controller 6 also monitors whether or not the difference between the indoor inlet temperature $T_{in}$ and the set temperature $T_{set}$ is less than or equal to the cooling thermo-off threshold value $T_{off_C}$ (S1). If the difference is larger than the cooling thermo-off threshold value $T_{off_C}$, that is, a thermo-off condition is not satisfied, normal operation is continued. On the other hand, if the difference between the indoor inlet temperature $T_{in}$ and the set temperature $T_{set}$ is less than or equal to the cooling thermo-off threshold value $T_{off_C}$, that is, the thermo-off condition is satisfied, the process proceeds to step S2 in which it is determined whether thermo-off postponement control is allowed or not. In step S2, it is determined whether the current compressor operating frequency $F_j$ is higher than the minimum operating frequency $F_{min}$ or the current compressor operating frequency $F_j$ is equal to the lowest operating frequency ($=F_{min}+F_\alpha$) subjected to up correction (i.e., subjected to addition of the current lowest operating frequency correction frequency $F_\alpha$) (S2).

If the controller 6 determines that none of the above conditions is not satisfied, that is, $F_j=F_{min}$, at step S2, the controller 6 determines that thermo-off postponement control is not allowed, and immediately performs thermo-off (S6). Specifically, a compressor operating frequency $F_{j+1}$ of the compressor 1 is set at 0 (zero) so as to stop operation. On the other hand, if the controller 6 determines that one of the above conditions is satisfied, the controller 6 determines that thermo-off postponement control is allowed, and the thermo-off postponement control is performed (S3). Specifically, the compressor operating frequency is reduced to the compressor operating frequency $F_{j+1}$ obtained by adding a new lowest operating frequency correction value (a negative value) $F_\beta$ to the current compressor operating frequency $F_j$, and operation of the compressor 1 continues. The compressor operating frequency $F_{j+1}$ is greater than or equal to the minimum operating frequency Film.

By reducing the compressor operating frequency $F_j$ to $F_{j+1}$, the air conditioning capacity decreases, and thus, the room temperature increases. Consequently, when the difference between the indoor inlet temperature $T_{in}$ and the set temperature $T_{set}$ increases to the cooling thermo-on threshold value $T_{on_C}$ or more, in other words, when the indoor inlet temperature $T_{in}$ increases to the thermo-on set temperature or more so that a thermo-on condition is satisfied (S4), the process returns to normal operation. In the normal operation of this example, operation is restarted in consideration of up correction of the lowest operating frequency of the compressor 1.

On the other hand, if the difference between the indoor inlet temperature $T_{in}$ and the set temperature $T_{set}$ is smaller than the cooling thermo-on threshold value $T_{on_C}$ and a thermo-on condition is not satisfied in step S4, the controller 6 checks the time elapsed from entering the thermo-off postponement control (S5). If the elapsed time is shorter than a predetermined thermo-off postponement duration time τk, the controller 6 returns to step S3, and processes of step S4 and step S5 are repeated with the thermo-off postponement control being continued (i.e., with the operating frequency kept at $F_{j+1}$). If the thermo-off postponement duration time τk is elapsed without the thermo-on condition being satisfied, the thermo-off postponement control is canceled and thermo-off is performed (S6).

After the thermo-off, if the time elapsed from the stop of operation of the compressor 1 is shorter than the predetermined minimum compressor stoppage period $\tau_{off}$ (S7), the controller 6 returns to step S6 and continues thermo-off. On the other hand, if the minimum compressor stoppage period $\tau_{off}$ elapses after thermo-off, the controller 6 determines whether the thermo-on condition is satisfied or not in a manner similar to that in step S4 (S8). If the controller 6 determines that the thermo-on condition is not satisfied, the controller 6 returns to step S6, whereas if the controller 6 determines that the thermo-on condition is satisfied, the controller 6 performs thermo-on (restart).

The foregoing description focuses on the cooling mode. Control in the heating mode is similar to that in the cooling mode except for the thermo-off condition in step S1 and the thermo-on condition in steps S4 and S8. In step S1 in the heating mode, if the difference between the set temperature $T_{set}$ and the indoor inlet temperature $T_{in}$ becomes less than or equal to a heating thermo-off threshold value $T_{off_H}$ (a negative value), the thermo-off condition is satisfied and it is determined that thermo-off is allowed. In steps S4 and S8 in the heating mode, if the difference between the set temperature $T_{set}$ and the indoor inlet temperature $T_{in}$ becomes greater than or equal to a heating thermo-on threshold value $T_{on_H}$, the thermo-on condition is satisfied and it is determined that thermo-on is allowed.

In the flowchart of FIG. 2, the thermo-off set temperature is a temperature obtained by adding the cooling thermo-off threshold value $T_{off_C}$ to the set temperature $T_{set}$. However, the thermo-off set temperature is not limited to this temperature, and may be a temperature obtained by subtracting the cooling thermo-off threshold value $T_{off_C}$ from the set temperature $T_{set}$. Similarly, in the heating mode, in the flowchart of FIG. 2, the thermo-off set temperature is a temperature obtained by adding the heating thermo-off threshold value $T_{off_H}$ to the set temperature $T_{set}$. However, the thermo-off set temperature is not limited to this temperature, and may be a temperature obtained by subtracting the heating thermo-off threshold value $T_{off_H}$ from the set temperature $T_{set}$.

Similarly, regarding the thermo-on condition, in the flowchart of FIG. 2, the thermo-on set temperature is a temperature obtained by adding the cooling thermo-on threshold value $T_{off_C}$ to the set temperature $T_{set}$. However, the thermo-on set temperature is not limited to this temperature, and may be a temperature obtained by subtracting the cooling thermo-on threshold value $T_{off_C}$ from the set temperature $T_{set}$. Similarly, in the heating mode, in the flowchart of FIG. 2, the thermo-on set temperature is a temperature obtained by adding the heating thermo-on threshold value $T_{on_H}$ to the set temperature $T_{set}$. Alternatively, the thermo-on set temperature may be a temperature obtained by subtracting the heating thermo-on threshold value $T_{on_H}$ from the set temperature $T_{set}$.

Figure 3A:
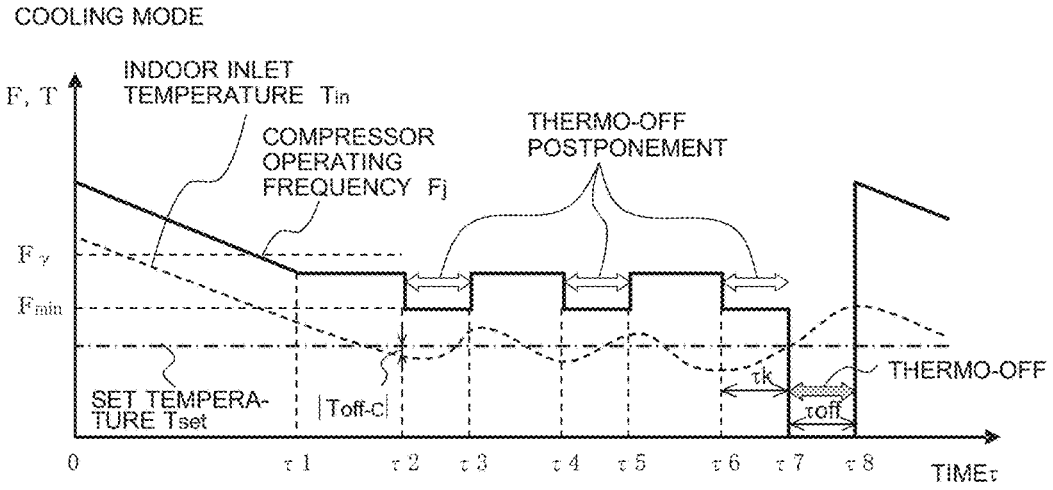
FIG. 3A shows changes in compressor operating frequency and indoor inlet temperature in the cooling operation when the control of the flowchart of FIG. 2 is performed.
Figure 3B:
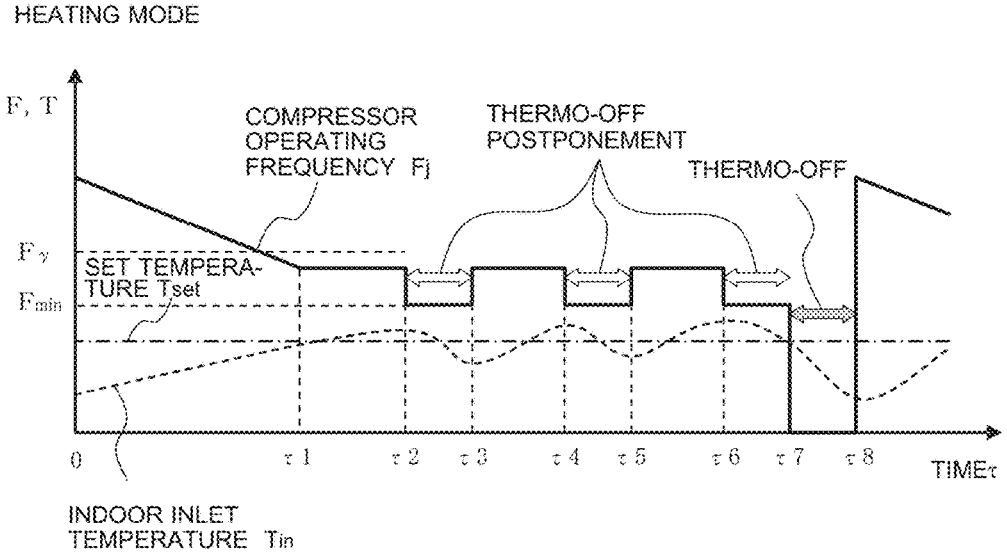
FIG. 3B shows changes in compressor operating frequency and indoor inlet temperature in the heating operation when the control of the flowchart of FIG. 2 is performed.

FIG. 3A shows changes in compressor operating frequency and indoor inlet temperature in the cooling operation when the control of the flowchart of FIG. 2 is performed. FIG. 3B shows changes in compressor operating frequency and indoor inlet temperature in the heating operation when the control of the flowchart of FIG. 2 is performed. In FIGS. 3A and 3B, the abscissa represents time $\tau$, and the ordinate represents temperature T or compressor operating frequency F. As described above, FIGS. 3A and 3B shows an example in which thermo-off postponement control is performed when condition (b) is satisfied in order to reduce an abrupt change in compressor operating frequency as described above.

As illustrated in FIG. 3A, once operation of the compressor 1 has been started, the indoor inlet temperature $T_{in}$ gradually decreases, and the difference between the indoor inlet temperature $T_{in}$ and the set temperature $T_{set}$ decreases. Accordingly, the compressor operating frequency $F_j$ also gradually decreases. At time $\tau 1$, the compressor operating frequency $F_j$ decreases to the lowest operating frequency after up correction. Then, at time $\tau 2$, the difference between the indoor inlet temperature $T_{in}$ and the set temperature $T_{set}$ becomes less than or equal to the cooling thermo-off threshold value $T_{off_C}$ (represented as $|T_{off_C}|$ in FIG. 3A), and the thermo-off condition is satisfied (i.e., YES at S1). In addition, the current compressor operating frequency $F_j$ is less than or equal to the threshold frequency $F_\gamma$ and higher than the minimum operating frequency $F_{min}$ (i.e., YES at S2). Thus, it is determined that thermo-off postponement control is allowed, and thermo-off postponement control starts at time $\tau 2$ (S3). That is, the compressor operating frequency $F_j$ is reduced to $F_{min}$, and operation is continued.

Once the thermo-off postponement control has been performed, the indoor inlet temperature $T_{in}$ starts increasing. When the thermo-on condition is satisfied (i.e., YES at S4) at time $\tau_3$, the thermo-off postponement control is switched to normal operation. That is, the compressor operating frequency $F_j$ is returned to an operating frequency before the thermo-on postponement control. The thermo-off condition is satisfied again at time $\tau 4$, and it is determined that the thermo-off postponement control is allowed (i.e., YES at S2) so that thermo-off postponement control is performed (S3).

Operations from time $\tau 2$ to time $\tau 4$ are repeated in the period from time $\tau 4$ to time $\tau 6$. During the operations (i.e., time $\tau 1$ to time $\tau 6$), the indoor inlet temperature $T_{in}$ fluctuates around the set temperature $T_{set}$. In typical control, thermo-off is performed immediately after the thermo-off condition has been satisfied. To prevent this, in a period of "thermo-off postponement" in FIG. 3A, the compressor 1 stops and an intermittent operation is performed. On the other hand, in the control of the present invention, the compressor 1 does not stop until time $\tau 7$, and continuous operation is performed. That is, in the control of the present invention, continuous operation can be performed as long as possible, and the likelihood of intermittent operation of the compressor 1 can be minimized.

At time $\tau 6$, thermo-off postponement control is performed again. Then, when the thermo-off postponement duration time $\tau k$ has elapsed (i.e., YES at S5), thermo-off is performed at time $\tau 7$ (S6). By performing thermo-off, the indoor inlet temperature $T_{in}$ increases above the set temperature. At time $\tau 7$, thermo-off is started, and the minimum compressor stoppage period $\tau_{off}$ has elapsed (i.e., YES at S7), and the thermo-on condition is satisfied (i.e., YES at S8). Then, the compressor 1 is subjected to thermo-on (i.e., is restarted).

The foregoing description focuses on the cooling mode. A change in compressor operating frequency in the heating mode is similar to that in the cooling mode except the change in indoor inlet temperature $T_{in}$ is opposite to that in the cooling mode as illustrated in FIG. 3B.

As described above, in Embodiment 1, when the thermo-off condition is satisfied, it is determined whether thermo-off postponement control is allowed or not on the basis of the current compressor operating frequency $F_j$. If it is determined that thermo-off postponement control is allowed, thermo-off postponement control in which the lowest operating frequency in the operating frequency range of the compressor 1 is temporarily reduced within a range greater than or equal to the minimum operating frequency of the compressor 1 in use is performed. Thus, a continuous operation can be performed as long as possible, and the likelihood of an intermittent operation of the compressor 1 can be minimized. Thus, a decrease in efficiency of the air-conditioning apparatus and a variation of the indoor inlet temperature caused by an intermittent operation can be reduced.

In a case where the current compressor operating frequency $F_j$ is higher than the minimum operating frequency of the compressor 1 in use or equal to the lowest operating frequency after up correction, it is determined that thermo-off postponement control is allowed. Thus, even in a case where the lowest operating frequency is increased in order to obtain reliability and maintain comfort of the air-conditioning apparatus and, thereby, even if the air conditioning capacity cannot be reduced sufficiently, the air conditioning capacity can be temporarily reduced so that operation continues. As a result, the likelihood of an intermittent operation of the compressor 1 can be minimized.

In addition, the thermo-off postponement duration time τk is provided so as to impose a limitation on a period in which thermo-off postponement control is performed. Thus, maintenance of reliability of the air-conditioning apparatus and maintenance of comfort, which are original objects of the invention, are not impaired. Thus, the air-conditioning apparatus can be stably operated with a higher degree of safety.

REFERENCE SIGNS LIST

1: compressor, 2: heat exchanger, 3: fan, 4: outdoor-air temperature detection means, 5: four-way valve, 6: controller, 6*a*: controller, 6*b*: controller, 7: outdoor unit, 8: heat exchanger, 9: fan, 10: inlet temperature detection means, 11: indoor unit, 12: remote controller, 13: expansion part.

The invention claimed is:

1. An air-conditioning apparatus comprising:

an outdoor unit including a compressor;

an indoor unit;

an inlet temperature detection unit that detects an indoor inlet temperature; and a controller that performs control of reducing an operating frequency of the compressor as a difference between the indoor inlet temperature and a set temperature decreases, wherein the controller is configured to:

perform control in which up correction is performed such that the lowest operating frequency in the operating frequency range of the compressor is increased in accordance with operating conditions to be a first frequency higher than the minimum operating frequency of the compressor in use and the first frequency is maintained, determine whether thermo-off postponement control is allowed or not on the basis of a current operating frequency of the compressor in a case where the indoor inlet temperature is less than or equal to a thermo-off set temperature in a cooling mode or the indoor inlet temperature is greater than or equal to the thermo-off set temperature in a heating mode so that a thermo-off condition is satisfied, perform thermo-off postponement control in which a lowest operating frequency in an operating frequency range of the compressor is reduced to a second frequency lower than the first frequency and greater than or equal to a minimum operating frequency of the compressor in use and the second frequency is maintained while an operation of the compressor is continued, when the controller determines that the thermo-off postponement control is allowed, and perform thermo-off in which the compressor is stopped, when the controller determines that the thermo-off postponement control is not allowed.

2. The air-conditioning apparatus of claim 1, wherein the controller is further configured to determine that the thermo-off postponement control is allowed, a case where a current compressor operating frequency is higher than the minimum operating frequency of the compressor in use or equal to a lowest operating frequency after the up correction.

3. The air-conditioning apparatus of claim 2, wherein the controller is further configured to perform the up correction in order to obtain at least one of reliability and a degree of comfort of the air-conditioning apparatus.

4. The air-conditioning apparatus of claim 1, wherein the controller is further configured to perform thermo-on in which the compressor is driven in a case where the indoor inlet temperature is greater than or equal to a thermo-on set temperature in the cooling mode or the indoor inlet temperature is less than or equal to the thermo-on set temperature in the heating mode so that a thermo-on condition is satisfied, and set the lowest operating frequency in the operating frequency range of the compressor to return to an operating frequency from before the thermo-off postponement control and carries on the operation, in a case where the thermo-on condition is satisfied by performing the thermo-off postponement control.

5. The air-conditioning apparatus of claim 1, wherein the controller is further configured to perform thermo-on in which the compressor is driven in a case where the indoor inlet temperature is greater than or equal to a thermo-on set temperature in the cooling mode or the indoor inlet temperature is less than or equal to the thermo-on set temperature in the heating mode so that a thermo-on condition is satisfied, and control the thermo-off postponement control, and perform the thermo-off, when a predetermined thermo-off postponement duration time has elapsed without the thermo-on condition being satisfied from the start of the thermo-off postponement control.

6. The air-conditioning apparatus of claim 1, wherein the controller is further configured to in response to determining that thermo-off postponement control is allowed:

repeatedly: (i) perform control in which the up correction is performed such that the lowest operating frequency in the operating frequency range of the compressor is increased to be the first frequency higher than the minimum operating frequency of the compressor in use and the first frequency is maintained, and (ii) perform thermo-off postponement control in which the lowest operating frequency in the operating frequency range of the compressor is reduced to the second frequency lower than the first frequency and the second frequency is maintained while the operation of the compressor is continued, and (iii) determine whether thermo-off postponement control is allowed or not on the basis of the thermo-off condition being satisfied;

then perform thermo-off in which the compressor is stopped when thermo-off postponement control is not allowed and the thermo-off condition is determined to be satisfied.

7. The air-conditioning apparatus of claim 6, wherein the controller is further configured to perform thermo-on in which the compressor is driven in a case where the indoor inlet temperature is greater than or equal to a thermo-on set temperature in the cooling mode or the indoor inlet temperature is less than or equal to the thermo-on set temperature in the heating mode so that a thermo-on condition is satisfied, and control the thermo-off postponement control, and perform the thermo-off, when a predetermined thermo-off postponement duration time has been elapsed without the thermo-on condition being satisfied from the start of the thermo-off postponement control.

8. The air-conditioning apparatus of claim 1, wherein the controller is further configured to during thermo-off postponement control, obtain the second frequency by adding a new lowest operating frequency correction value to the current operating frequency of the compressor, wherein the second frequency is lower than the first frequency which is the current operating frequency which is higher than the minimum operating frequency of the compressor in use.

* * * * *